US011834208B2

(12) United States Patent
Bonnain et al.

(10) Patent No.: US 11,834,208 B2
(45) Date of Patent: Dec. 5, 2023

(54) APPARATUS AND METHOD FOR FOLDING LOWER RETENTION FLAPS

(71) Applicant: WestRock Packaging Systems, LLC, Atlanta, GA (US)

(72) Inventors: Jean-Christophe Bonnain, Châteauroux (FR); Emmanuel Davaillon, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 1018 days.

(21) Appl. No.: 16/448,809

(22) Filed: Jun. 21, 2019

(65) Prior Publication Data

US 2020/0399002 A1 Dec. 24, 2020

(51) Int. Cl.

| | |
|---|---|
| ***B65B 11/04*** | (2006.01) |
| ***B65B 11/00*** | (2006.01) |
| ***B65B 21/24*** | (2006.01) |
| ***B65B 41/02*** | (2006.01) |
| ***B65B 43/10*** | (2006.01) |

(52) U.S. Cl.

CPC ..... *B65B 11/004* (2013.01); *B65B 21/24* (2013.01); *B65B 41/02* (2013.01); *B65B 43/10* (2013.01)

(58) Field of Classification Search

CPC ..... B65B 11/004; B65B 21/24; B65B 41/02; B65B 43/10

USPC ..... 53/456

See application file for complete search history.

(56) References Cited

U.S. PATENT DOCUMENTS

| | | | | |
|---|---|---|---|---|
| 3,045,401 | A | 7/1962 | Henry | |
| 3,085,377 | A | 4/1963 | Ganz | |
| 3,461,642 | A * | 8/1969 | Langen | B65B 43/10 493/131 |
| 3,572,003 | A * | 3/1971 | Perry | B65B 11/105 53/48.9 |
| 4,612,753 | A * | 9/1986 | Taylor | B65B 21/24 53/48.9 |

FOREIGN PATENT DOCUMENTS

| | | | | |
|---|---|---|---|---|
| CA | 753045 | A | 2/1967 | |
| WO | WO-2007120969 | A2 * | 10/2007 | B65B 21/24 |

OTHER PUBLICATIONS

International Search Report for PCT/US2020/034178 dated Aug. 6, 2020.

* cited by examiner

*Primary Examiner* — Valentin Neacsu
*Assistant Examiner* — Mary C Hibbert-Copeland
(74) *Attorney, Agent, or Firm* — Brian J. Goldberg; Rohini K. Garg

(57) ABSTRACT

A system including a pair of prongs extending in a transverse direction, spaced apart from one another by a gap configured to receive carton blanks and product containers therein, and to crease retention flaps of the carton blank, wherein each prong travels along a cam path, a panel extending in a longitudinal direction in-between the pair of prongs configured to support the product containers and guide the retentions flaps, a pair of asymmetrical guide rails underneath the panel configured to alternatingly crease a first primary flap and a second primary flap of the carton blank, and a conveyor mechanism proximate to the panel configured to move they product container and a carton blanks along the panel.

19 Claims, 10 Drawing Sheets

APPARATUS AND METHOD FOR FOLDING LOWER RETENTION FLAPS

BACKGROUND OF THE INVENTION

1. Field of the Invention

The present disclosure relates to packaging, and more particularly to systems and methods for packaging multiple product units, such as cans or bottles, together.

2. Description of Related Art

One way of packaging multiple bottles or cans together utilizes a paperboard wrapper which is wrapped around four of the six sides of a grouping of cans or bottles. For example, a paperboard wrapper or carton can be wrapped around the top, left, bottom, and right sides of a two-by-two group of four cans. A similar paperboard carton can be used with the same technique to package a two-by-three six pack of cans.

The conventional techniques have been considered satisfactory for their intended purpose. However, there is an ever present need for improved systems and methods for packaging. This disclosure provides a solution for this need.

SUMMARY OF THE INVENTION

A system including a pair of prongs extending in a transverse direction, spaced apart from one another by a gap configured to receive carton blanks and product containers therein, and to crease retention flaps of the carton blank, wherein each prong travels along a cam path, a panel extending in a longitudinal direction in-between the pair of prongs configured to support the product containers and guide the retentions flaps, a pair of asymmetrical guide rails underneath the panel configured to alternatingly crease a first primary flap and a second primary flap of the carton blank, and a conveyor mechanism proximate to the panel configured to move they product container and a carton blanks along the panel.

Each of the prongs includes multiple tines, each tine which can be slidably attached to the cam path, wherein the cam path can include a section directed in the transverse direction configured to direct each tine towards and away from the panel individually. Each of the prongs can be attached to each other and be configured to move in the transverse direction together. Each of the prongs can be attached to and driven by a continuous chain along the cam path.

The panel can include a top face configured to support the product containers, a pair of opposing sides each including a primary groove each configured to receive one of the prongs and one of the retention flaps, and a blocker within each of the grooves, each forming a secondary groove configured to retain the retention flaps until the primary flaps reach the asymmetrical guide rails. Each of the blockers can extend only partially within each of the grooves.

The panel can transitions from a single pathway to a three-branched pathway along a length thereof. A width of the panel can be constant along the length thereof. The three branched pathway includes a central branch having a constant width interspersed between two narrowing branches, wherein a widening channel can be disposed between each narrowing branch and the central branch configured to receive the retention flaps. The pair of asymmetrical guide rails can be located downstream of the transition of the single pathway to the three-branched pathway.

The conveyor mechanism includes an arm for pushing the product containers along the pathway in order to effectuate a method including guiding a pack of product containers partially surrounded by a carton blank along a pathway, folding a leading retention flap of a first lower flap of the carton blank, folding a leading retention flap of a second lower flap of the carton blank, folding a trailing retention flap of a first lower flap of the carton blank, folding a trailing retention flap of a second lower flap of the carton blank, wherein the retention flaps are folded using a retractable prong, folding the first lower flap of a carton blank using a first rail guide; folding the second lower flap of the carton blank using a second rail guide, passing the leading and trailing upper retention flaps of the first and second lower flaps in a folded condition into a gap between a pair of guide rails, interlocking the leading retention flap with a leading product container of a pack of containers, interlocking the trailing retentions flap with a trailing product container of the pack of containers, and wrapping the carton blank around the pack of containers to package the product containers together.

The method can include folding a central retention flap of a first lower flap of the carton blank and folding a central retention flap of the second lower flap of the carton blank. Folding the retention flaps can include pressing each of the flaps by driving a corresponding prong, retracting each prong, and retaining each of the flaps in a folded position by a blocker located within a grove of the pathway. Folding the first lower flap of the carton blank and folding the second lower flap of the carton blank can occur after retracting each prong.

Interlocking can include pressing each of the retention flaps into an underside cavity of a product container. The pack of product can be a two-by-three six pack of cans. Folding the first and second lower flaps can be performed with access from below the carton blank as the product container is below the blank. The trailing retention flaps can folded after the leading retention flaps.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
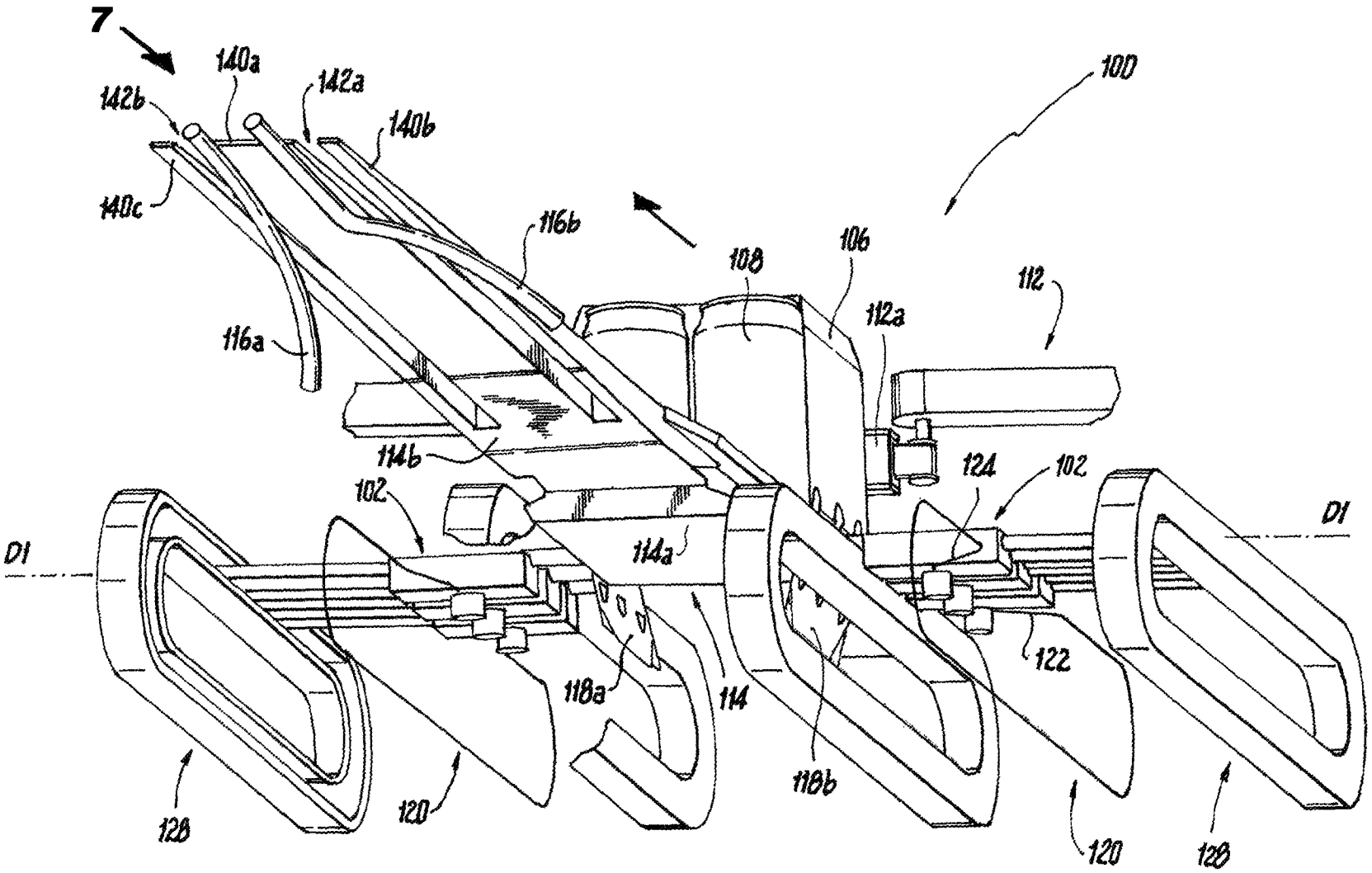
FIG. 1 is a perspective view of an embodiment of a system constructed in accordance with the present disclosure, showing the anvil from a viewpoint above the carton blanks.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIGS. 2-9, as will be described. The systems and methods described herein can be used to fold upper flaps of carton blanks for engagement with product units, such as beverage cans, to lock the product units in the carton after wrapping the carton around a pack of the product units.

FIG. 1, shows a system 100 for moving and packing products includes a pair of prongs 102 extending in a transverse direction (D1) to crease retention flaps 110 of the carton blank 106. Carton blanks 106 and product containers 108 are driven by a conveyor mechanism 112 proximate. The conveyor mechanism 112 can includes an arm 112*a* for pushing the product containers along. It is also conceived that a suction or belt can be arranged proximate to the carton blanks in order to move them along. A panel 114 extends in a longitudinal direction D2 in-between the pair of prongs 102. The panel 114 supports the product containers 108 and guides the retentions flaps 110. A pair of asymmetrical guide rails 116 underneath the panel 114 alternatingly creases a first primary flap 118*a* and a second primary flap 118*b* of the carton blank as the blank 106 moves towards the end of the panel.

Figure 2:
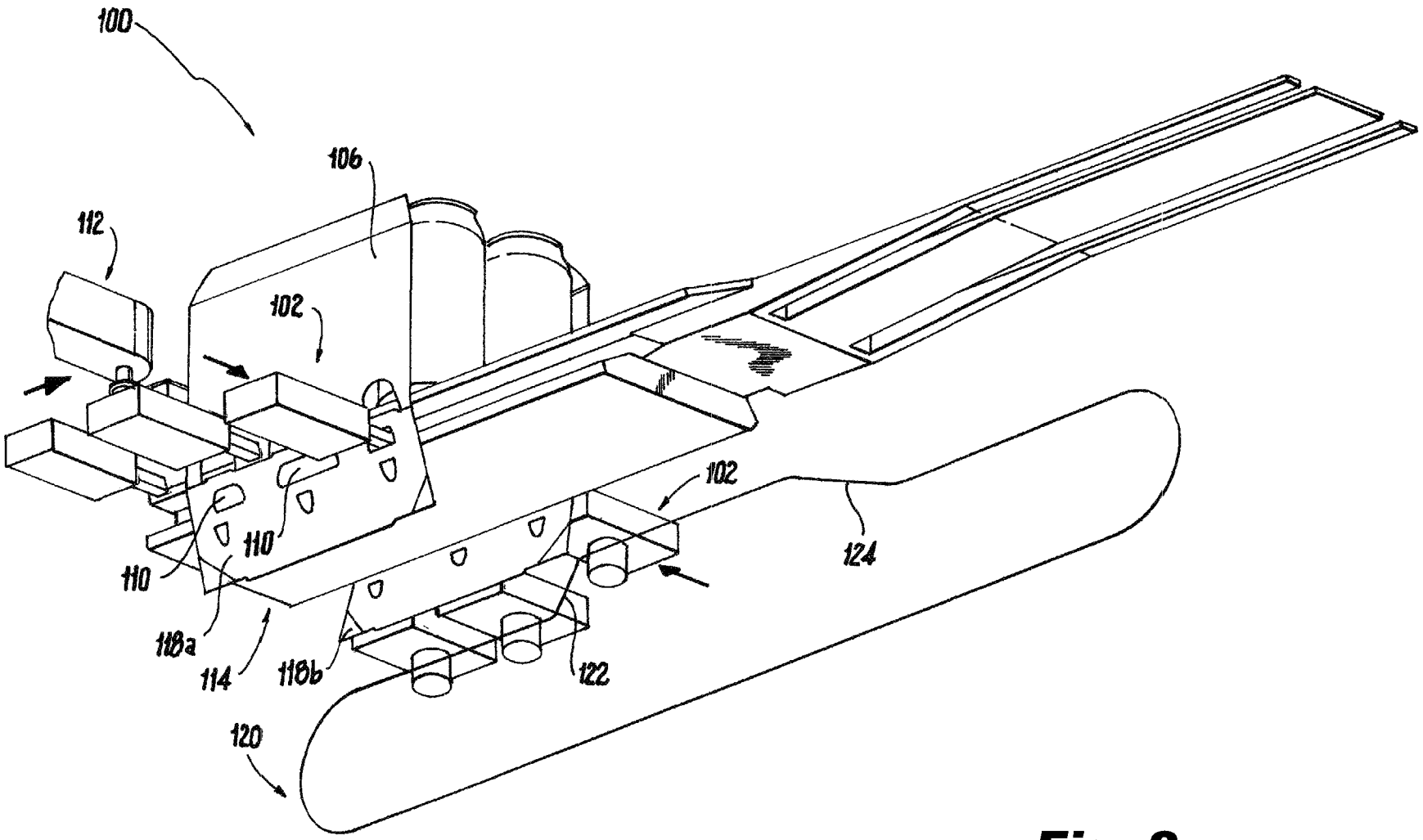
FIG. 2 is a perspective view of the system of FIG. 1, from a viewpoint below the carton blanks.
Figure 3:
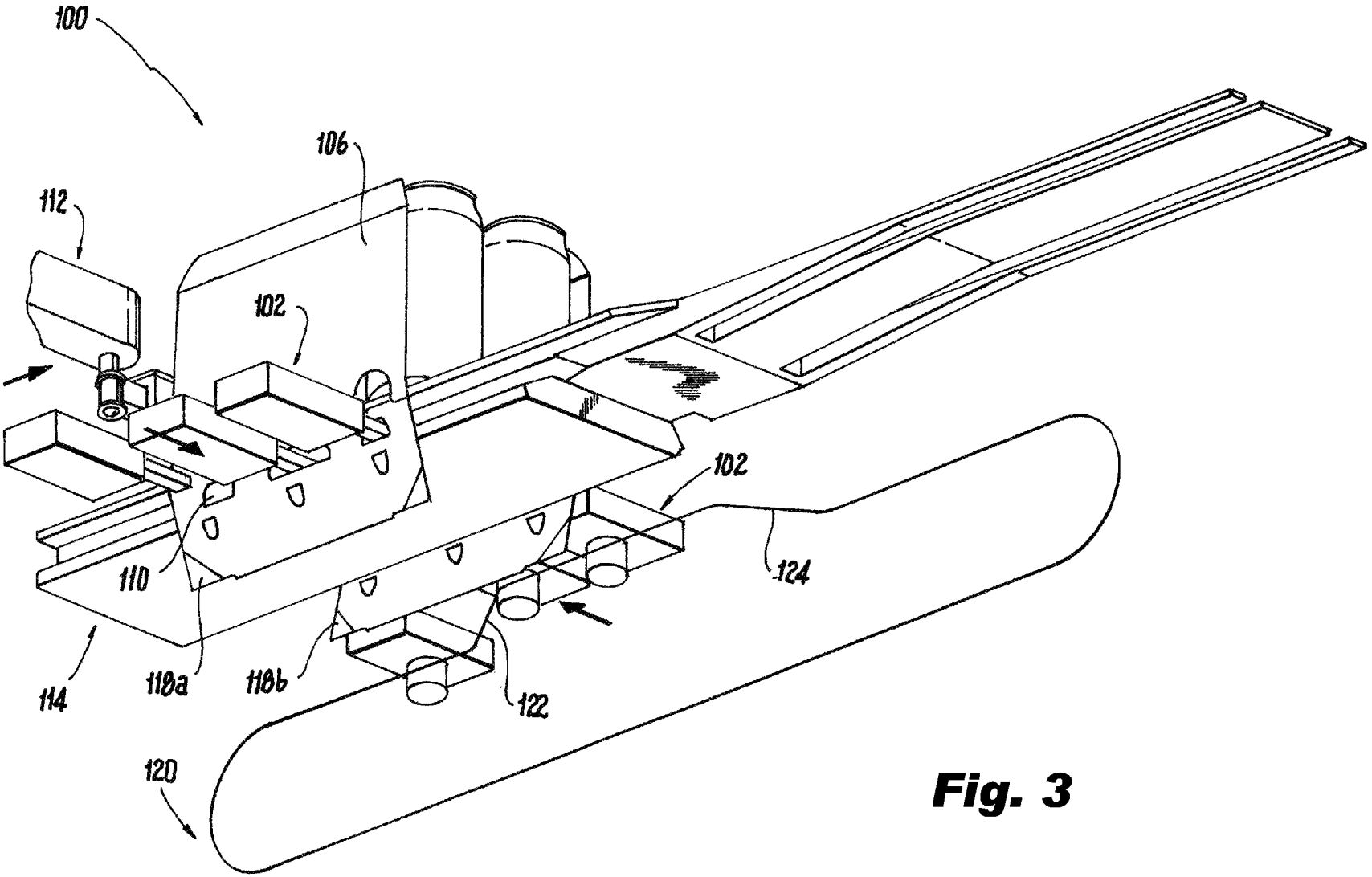
FIG. 3 is a perspective view of an embodiment of a system constructed in accordance with the present disclosure, showing the lugs in a second position.
Figure 4:
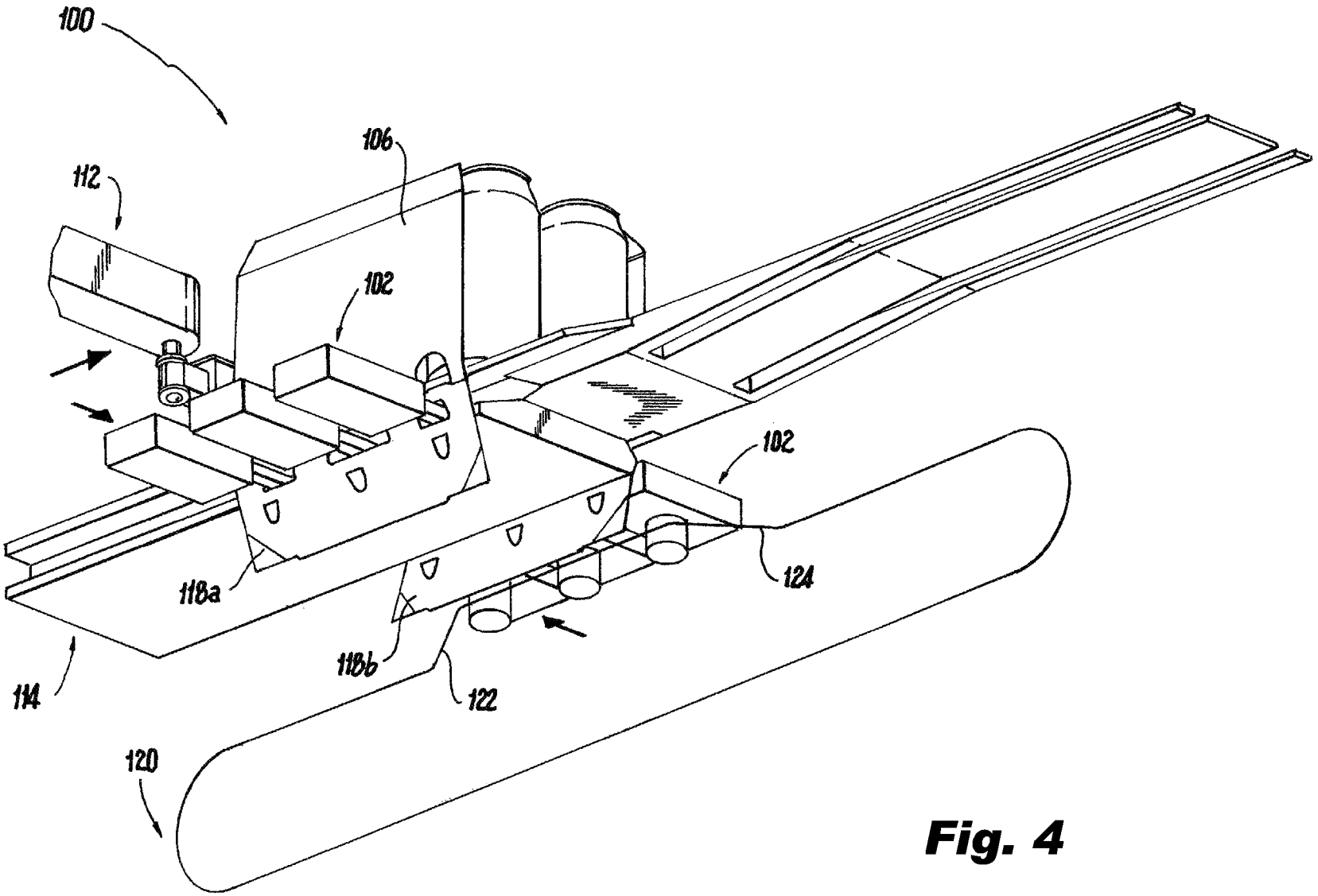
FIG. 4 is a perspective view of an embodiment of a system constructed in accordance with the present disclosure, showing the lugs in a third position.

FIG. 2-4 shows the prong 102 attached to a cam path 120 and their various positions along the cam path 120. The prong 102 travels along cam path 120. The cam path 120 includes a section directed in the transverse direction 122. When the prong 102 reaches section 122 the prong is directed towards the panel 114 (FIG. 3), and pushes in one of the retention flaps 110 of the carton blank 106, and when the prong reaches section 124 the prong 102 is directed to retract (FIG. 4), away from panel 114. The prong 102 includes three individual tines 126*a-c*. Each tine 126*a-c* can be directed towards and away from the panel 114 individually. It is also conceived that only the central tine 126*b* is specifically connected to the cam path 120 and all the tines 126*a-c* are directed towards the panel 114 simultaneously. The prongs are attached to and driven by a continuous chain 128 along the cam path 120. The chain 128 can be controlled to speed up and slow down as required by the individual product lines.

Figure 5:
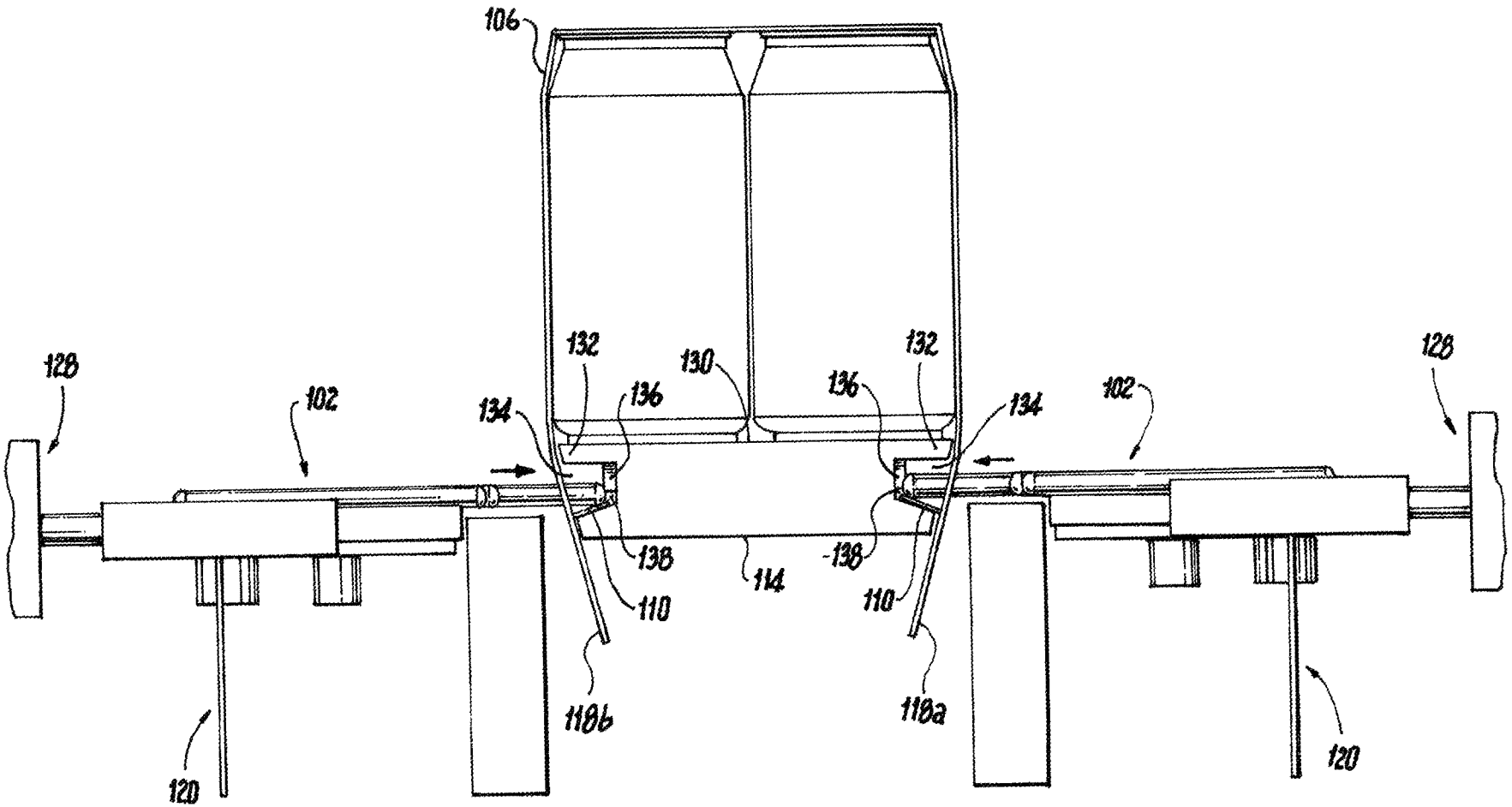
FIG. 5 is a rear view of the system of FIG. 1, showing a retention flap pressed by the lugs and an entering the primary groove.
Figure 6:
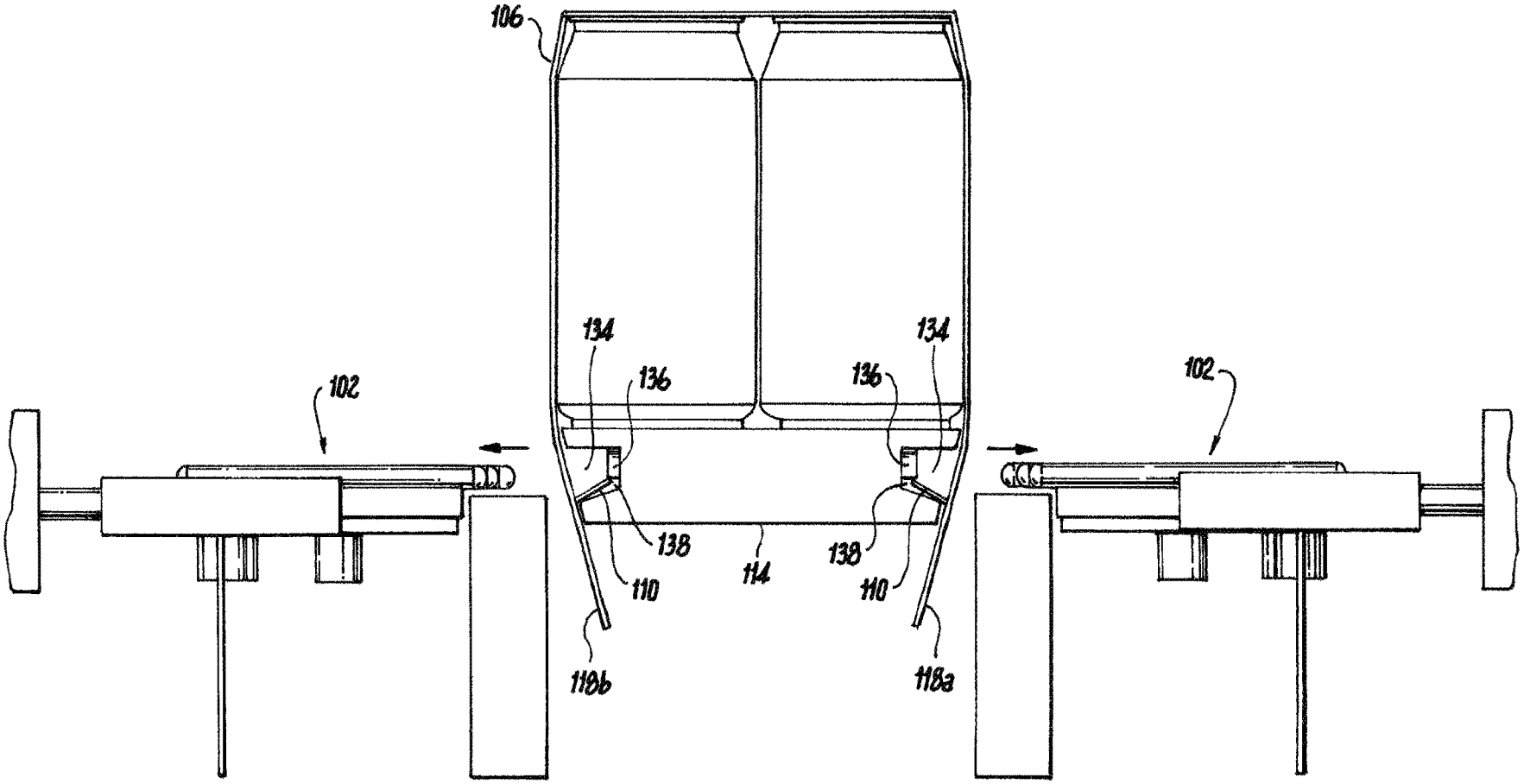
FIG. 6 is a rear view of the system of FIG. 1, showing a retention flap released by the lugs and contacting a blocker within a secondary groove.

FIGS. 5 and 6 show how the retention flaps 110 and the carton blank 106 interacts with various portions of the panel 114. The panel 114 includes a top face 130 along which the product containers are moved. The panel 114 includes a pair of opposing sides 132 each including a primary groove 134 which receive the tines 126*a-c* and the retention flaps 110. A blocker 136 is positioned along the primary grove 134. The blocker 136 forms a secondary groove 138 within the primary groove 134. The retention flaps 110 are first pressed into the primary groove 134 by the prongs 102, and then travel into the secondary groove 138. As the prongs are retracted when the prongs reach section 124, the retention flaps 110 will have a natural tendency to snap back into original formation. The underside of blocker 136 keeps them from doing so and keeps them bent, as seen in FIG. 6. The blockers 136 extend only partially within each of the grooves 134.

Figure 7:
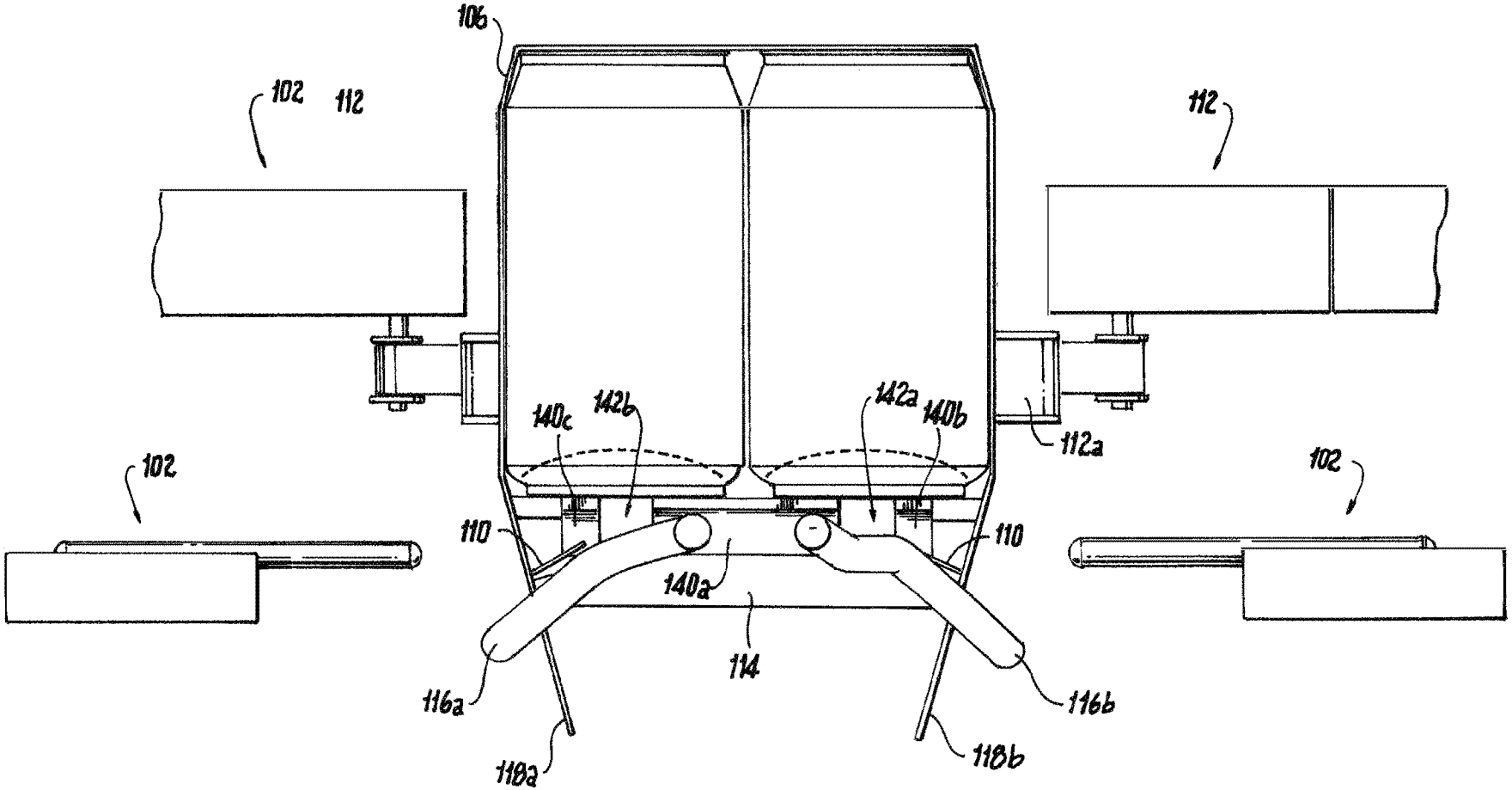
FIG. 7 is a front view of the system of FIG. 1, showing the primary flap in a first position and contacting the guide rail.
Figure 8:
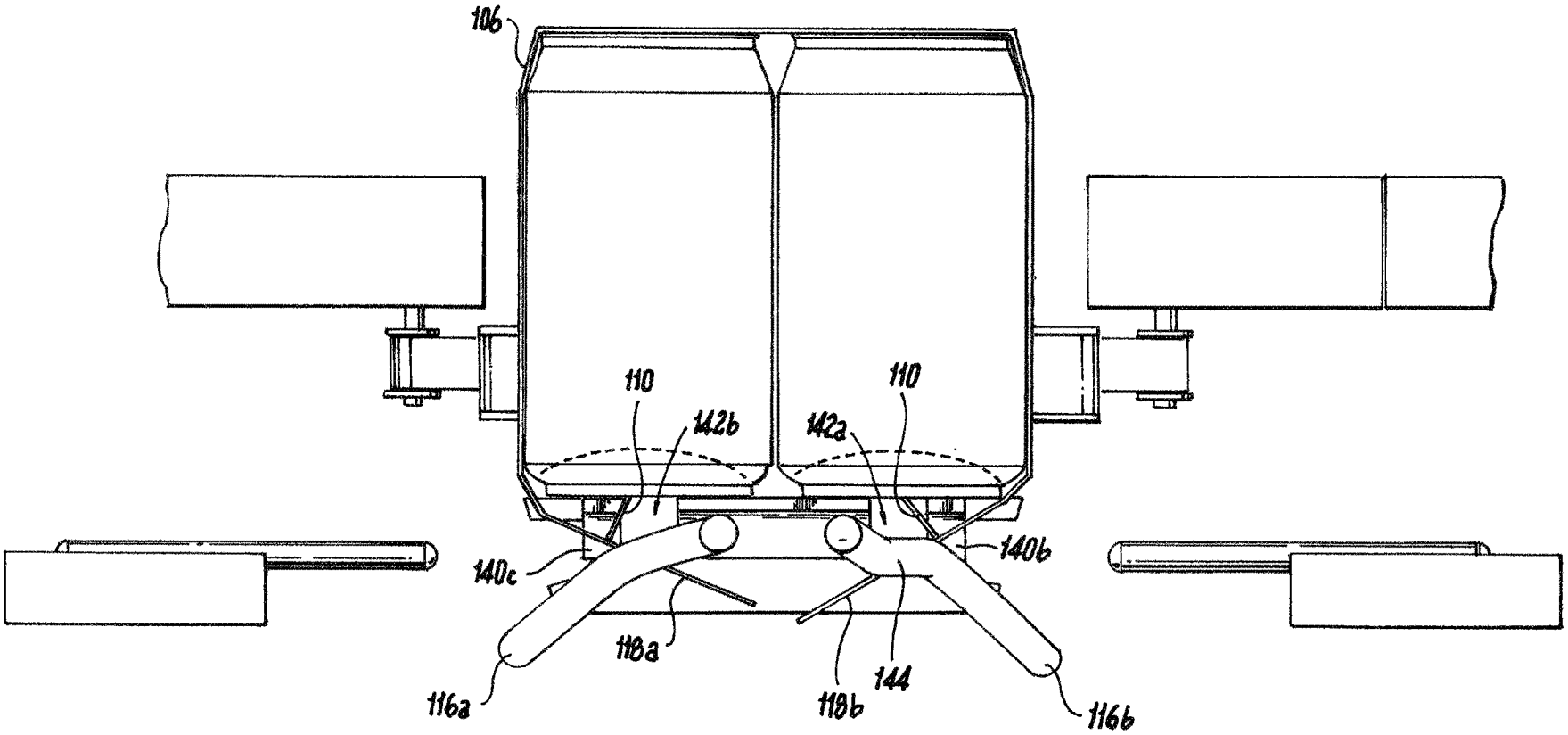
FIG. 8 is a front view of the system of FIG. 1, showing the primary flap in a second position and the retention flaps within the widening channel.
Figure 9:
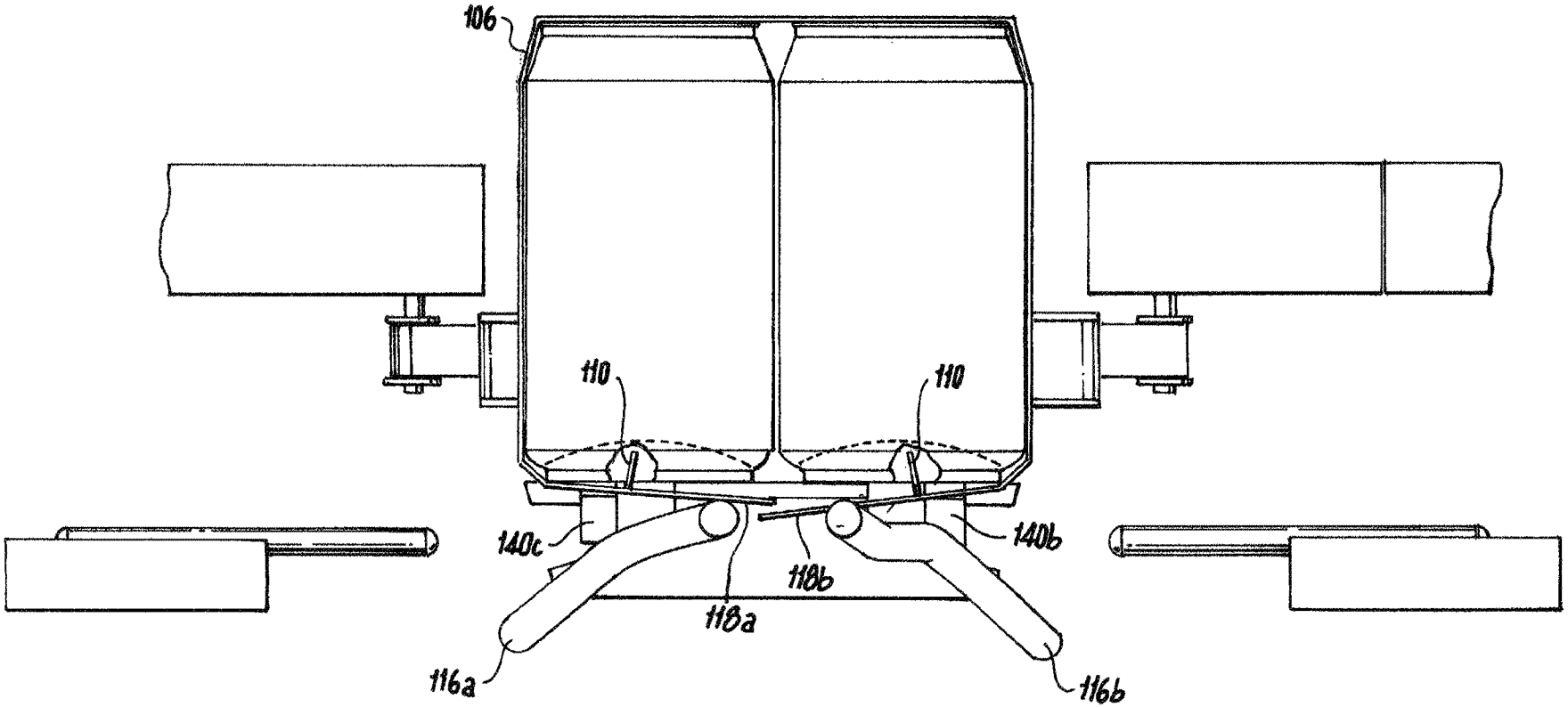
FIG. 9 is a front view of the system of FIG. 1, showing the primary flap in a third position and the retention flaps contacting portions of the undersides of the containers.

FIGS. 7-9 focus on a downstream portion of panel 114. As the prongs 102 retract and the product containers reach a certain point the panel 114 transitions from a single pathway 114*a* to a three-branched pathway 114*b*. The width of the panel stays constant. The three branched pathway 114*b* includes a central branch 140*a*, having a constant width. The central branch is positioned between two narrowing branches 140*b* and 140*c*. The branches 140*b/c* narrow in the direction of travel of the product containers. As a result a widening channel 142*a/b* is disposed between each narrowing branch 140*b/c* and the central branch 140*a*. As the retention flaps 110 reach the end of the blocker 136, the retention flaps 110 enter the widening channels 142*a/b* and are biased against the inner surface of the branches 140*b/c* as the primary flaps 118*a/b* are driven upwards by the asymmetrical guide rails 116. The pair of asymmetrical guide rails 116 are located downstream of the transition of the single pathway 114*a* to the three-branched pathway 114*b*. The asymmetric guide rails are asymmetric in the sense that they start the same location, but one of them includes a dwelling section 144, wherein the guide rail 116*b* does not rise and does not press the primary flap 118*b* up, allowing the flaps 118 to alternatingly close around the product container.

FIG. 9 shows how the leading retention flap 110*a* is interlocked with a leading product container of a pack of containers. The retention flap 110*a* is shaped to fit into the cavity of the underside of the product container. As the product containers slide forward the trailing retention flap 110*c* is slid and pressed into the underside of the trailing package container. This arrangement is show as a 2 by 3 back, but can also be used for any number of arrangements including 2 by 2, or 2 by 6, as long as a leading and trailing container are locked in place, the central container are prevented from sliding out of the folded carton.

Figure 10:
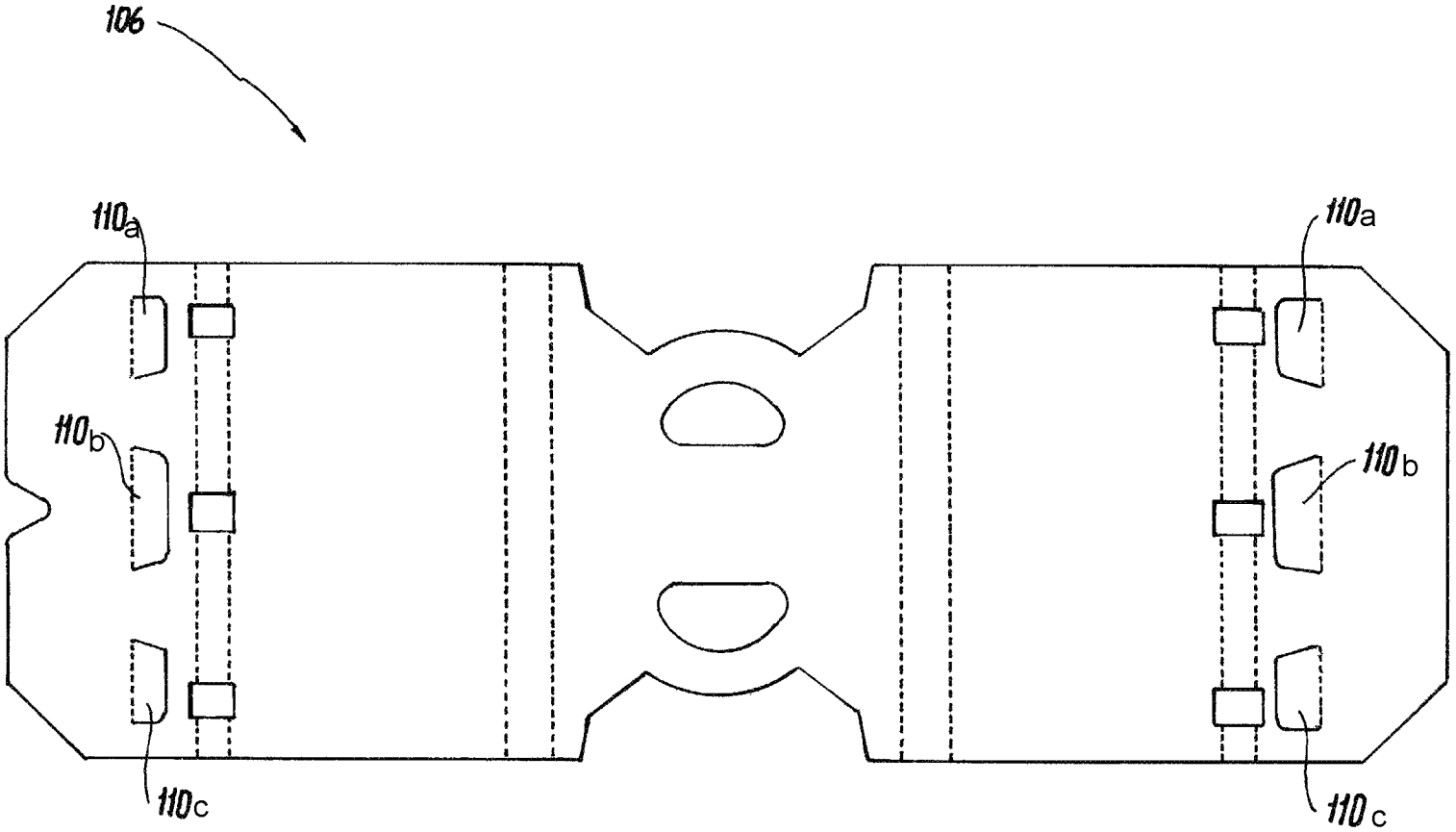
FIG. 10 is a top view of a blank of FIG. 1, showing the primary flap and the retention flaps in an unfolded position.

FIG. 10 shows an unfolded blank 106. The unfolded blank shows a central retention flap 110*b*, being longer than the leading 110*a* and trailing 110*c* retention flaps. The leading and trailing retention flaps are only responsible for preventing movement in one direction, while the central flap prevents movement of the central product container of the package in both direction. This arrangement allows for less packaging material to be used to secure the product containers in place. As shown in the previous Figures, the product containers partially protrude past the border of the blank in both directions but are nevertheless held secure.

The methods and systems of the present disclosure, as described above and shown in the drawings, provide for packaging product units such a beverage cans within cartons with superior properties including ease us use and reliability. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

a pair of prongs extending in a transverse direction, spaced apart from one another by a gap configured to receive a carton blank and product containers therein, and to crease retention flaps of the carton blank, wherein each prong travels along a cam path;

a panel extending in a longitudinal direction in-between the pair of prongs configured to support the product containers and guide the retention flaps, wherein the transverse direction is transverse to the longitudinal direction;

a pair of asymmetrical guide rails underneath the panel configured to alternatingly crease a first primary flap and a second primary flap of the carton blank; and a conveyor mechanism proximate to the panel configured to move the product containers and a carton blank along the panel in the longitudinal direction.

2. The system of claim 1, wherein each of the prongs includes multiple tines, each tine slidably attached to the cam path, wherein the cam path includes a section directed in the transverse direction configured to direct each tine towards and away from the panel individually.

3. The system of claim 1, wherein each of the prongs are attached to each other and are configured to move in the transverse direction together.

4. The system of claim 1, wherein each of the prongs is attached to and driven by a continuous chain along the cam path.

5. The system of claim 1, wherein the panel includes:

a top face configured to support the product containers;

a pair of opposing sides each including a primary groove each configured to receive one of the prongs and one of the retention flaps; and a blocker within each of the primary grooves, each forming a secondary groove configured to retain the retention flaps until the primary flaps reach the asymmetrical guide rails.

6. The system of claim 5, wherein each of the blockers extend only partially within each of the primary grooves.

7. The system of claim 1, wherein the panel transitions from a single pathway to a three-branched pathway along a length thereof.

8. The system of claim 7, wherein a width of the panel is constant along the length thereof.

9. The system of claim 7, wherein the three branched pathway includes:

a central branch having a constant width interspersed between two narrowing branches, wherein a widening channel is disposed between each narrowing branch and the central branch configured to receive the retention flaps.

10. The system of claim 7, wherein the pair of asymmetrical guide rails are located downstream of the transition of the single pathway to the three-branched pathway.

11. The system of claim 1, wherein the conveyor mechanism includes an arm for pushing the product containers along the pathway.

12. A method comprising:

guiding a pack of product containers partially surrounded by a carton blank along a pathway;

folding a leading retention flap of a first lower flap of the carton blank;

folding a leading retention flap of a second lower flap of the carton blank;

folding a trailing retention flap of a first lower flap of the carton blank;

folding a trailing retention flap of a second lower flap of the carton blank, wherein the retention flaps of each of the lower flaps are folded using a pair of retractable prongs extending in a transverse direction;

folding the first lower flap of a carton blank using a first rail guide;

folding the second lower flap of the carton blank using a second rail guide;

passing the leading and trailing upper retention flaps of the first and second lower flaps in a folded condition into a gap between a pair of guide rails;

interlocking the leading retention flap with a leading product container of a pack of containers;

interlocking the trailing retention flap with a trailing product container of the pack of containers; and wrapping the carton blank around the pack of containers to package the product containers together.

13. The method of claim 12, further comprising folding a central retention flap of a first lower flap of the carton blank and folding a central retention flap of the second lower flap of the carton blank.

14. The method of claim 12, wherein folding the retention flaps includes pressing each of the flaps by driving a corresponding prong, retracting each prong, and retaining each of the flaps in a folded position by a blocker located within a groove of the pathway.

15. The method of claim 14, wherein folding the first lower flap of the carton blank and folding the second lower flap of the carton blank occurs after retracting each prong.

16. The method of claim 12, wherein the interlocking includes pressing each of the retention flaps into an underside cavity of a product container.

17. The method of claim 12, wherein the pack of product is a two-by-three six pack of cans.

18. The method of claim 12, wherein folding the first and second lower flaps is performed with access from below the carton blank as the product containers are below the blank.

19. The method of claim 12, wherein the trailing retention flaps are folded after the leading retention flaps.

* * * * *